US007234171B2

(12) United States Patent
Rowe et al.

(10) Patent No.: US 7,234,171 B2
(45) Date of Patent: Jun. 26, 2007

(54) EXPANDABLE MATERIAL FOR USE IN A GARMENT

(75) Inventors: Patricia L. Pyeatt Rowe, Alpharetta, GA (US); Julia A. Ambrose, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 128 days.

(21) Appl. No.: 10/955,698

(22) Filed: Sep. 30, 2004

(65) Prior Publication Data

US 2006/0064797 A1 Mar. 30, 2006

(51) Int. Cl.
*A41D 13/12* (2006.01)

(52) U.S. Cl. ..... 2/114

(58) Field of Classification Search ..... 2/114, 2/51, 105, 69, 102, 108, 227, 115, 181; 428/181
See application file for complete search history.

(56) References Cited

U.S. PATENT DOCUMENTS 2,398,537 A * 4/1946 Koret ..... 2/212
2,570,777 A 10/1951 Dessauer
2,705,804 A * 4/1955 Walker ..... 2/83
3,106,717 A * 10/1963 Cuvin ..... 2/70
3,843,971 A * 10/1974 Delanty et al. ..... 2/114
4,040,124 A * 8/1977 Zoephel ..... 2/51
4,041,203 A 8/1977 Brock et al.
4,326,300 A * 4/1982 Bolton et al. ..... 2/114
4,601,066 A * 7/1986 Campbell ..... 2/70
4,670,907 A 6/1987 Gutterman et al.
4,697,288 A * 10/1987 Palumbo ..... 2/269
4,949,668 A 8/1990 Heindel et al.
5,155,867 A * 10/1992 Norvell ..... 2/113
5,274,852 A * 1/1994 Hogan ..... 2/114
5,705,251 A * 1/1998 Morman et al. ..... 428/114
5,708,977 A * 1/1998 Morkunas ..... 2/80
5,860,965 A * 1/1999 Lavash et al. ..... 604/390
6,110,156 A * 8/2000 Mendonca ..... 604/345
6,308,875 B1 * 10/2001 Almo ..... 224/660
6,374,414 B1 * 4/2002 Collier ..... 2/69
6,468,630 B1 * 10/2002 Mishima et al. ..... 428/181
6,564,386 B2 * 5/2003 Fujikawa et al. ..... 2/51

(Continued)

FOREIGN PATENT DOCUMENTS

DE 19715134 10/1998

(Continued)

*Primary Examiner*—Alissa Hoey
(74) *Attorney, Agent, or Firm*—Scott B. Garrison; James B. Robinson

(57) ABSTRACT

A protective garment having an expandable material incorporated therein is provided. The expandable material may be formed of a nonwoven fabric having a first fabric surface and a second fabric surface which is opposite the first fabric surface. A section of the fabric defines at least one region gathered into a plurality of successive pleats. Each pleat is made of an overlap in the fabric such that a portion of the first fabric surface is disposed adjacent to another portion of the first fabric surface. A secondary panel for straddling a pleat may be provided. The secondary panel may be attached to the fabric by attachment points that are adapted to retain the pleat in a folded state until application of a tensile force directed along the fabric length causes the secondary panel to separate which would enable the pleat to unfold.

7 Claims, 4 Drawing Sheets

U.S. PATENT DOCUMENTS

| | | | | |
|---|---|---|---|---|
| 6,733,484 | B2 * | 5/2004 | Van Gompel et al. | 604/385.16 |
| 2004/0133967 | A1 * | 7/2004 | West | 2/247 |
| 2005/0132465 | A1 * | 6/2005 | Kathumbi-Jackson et al. | 2/114 |

FOREIGN PATENT DOCUMENTS

| | | | |
|---|---|---|---|
| FR | 1574856 | | 7/1969 |
| FR | 2565794 | | 12/1985 |
| GB | 2269085 | | 2/1994 |
| JP | 2001303339 | A * | 10/2001 |
| WO | WO 01/03528 | | 1/2001 |

* cited by examiner

EXPANDABLE MATERIAL FOR USE IN A GARMENT

BACKGROUND OF THE INVENTION

The present invention relates generally to user adjustable or expandable materials for use in protective apparel or garments. More specifically, a user adjustable or expandable material for use in an adjustable protective garment is disclosed. A garment using such a material will be capable of providing some protection for an individual in a hazardous environment while permitting easy size adjustability. Protective apparel or garments, such as coveralls and gowns, designed to provide barrier protection to a wearer are well known in the art. Such protective garments are used in situations where isolation of a wearer from a particular environment is desirable, or it is desirable to inhibit or retard the passage of hazardous liquids and biological contaminates through the garment to the wearer.

For example, in the medical and health-care industry, particularly with surgical procedures, a primary concern is isolation of the medical practitioner from patient fluids such as blood, saliva, perspiration, etc. Protective garments rely on the barrier properties of the fabrics used in the garments, and on the construction and design of the garment. Openings or seams in the garments may be unsatisfactory, especially if the seams or openings are located in positions where they may be subjected to stress and/or direct contact with the hazardous substances.

Originally, surgical gowns were made of linen, the gowns being sterilized prior to use in the operating room. Linen gowns were not capable of preventing "strikethrough" of various liquids encountered during surgical procedures. As a result, the wearer's clothes came into contact with blood and the like, and a path was established for the transmission of bacteria to and from the wearer of the gown. Additionally, linen gowns, due to their high cost, had to be used a number of times, thus necessitating laundering and sterilization between successive uses.

In an attempt to reduce strike-through of liquids and to eliminate the need for repeated laundering and sterilization, disposable gowns were made from fluid repellent nonwoven fabrics. These gowns reduced liquid strike-through for a limited time. However, due to the generally inextensible nature of these nonwoven fabric constructions typically they tend to have less ability to conform to the body than the previously used linens or knits. In order to accommodate for a range of body shapes and sizes, the gown is designed to be loose fitting especially in the chest region, sleeve length, and gown length. Making the gown loose fitting generally minimizes the possibility that the gown may otherwise be undesirably too tight in some area or areas. However, this creates the very obvious problem that the gown will be too big for some wearers. By making the gown oversize a wearer having body dimensions smaller than the maximum size contemplated by the gown is subject to areas or regions of the gown or sleeve that hang or are caused to hang loosely. This phenomenon is known as "blousing". Unfortunately blousing often occurs in or at regions which may be undesirable for the intended use of the gown. Such areas often include the chest region, sleeve area, and the overall length of the gown itself.

Moreover, many health care facilities purchase only the extra large size version of surgical gowns in order to minimize the volume of different inventory they must maintain on site. In order to fit these gowns to an individual who may be smaller than that intended by the gown size, the typical wearer resorts to taping sections of the gown together to minimize blousing, for example, in the sleeve area or chest region as well as cutting portions of the gown away so as to shorten the overall length of the gown or shorten the sleeve length.

Thus, a need exists for an improvement in materials which may provide some degree of adjustability to an end user that may be incorporated into user worn protective apparel or garments. Such a material would be capable of being easily incorporated into the protective garment and would also be economically cost effective to implement and practice.

SUMMARY OF THE INVENTION

Objects and advantages of the invention will be set forth in the following description, or may be obvious from the description, or may be learned through practice of the invention.

The present invention relates to a material that may be found useful in making a unique configuration of a protective garment, particularly a surgical gown, wherein regions of extensible material are selectively provided in the garment to provide for adjustability to accommodate various size wearers. The areas or regions containing extensible materials may be incorporated into the garment by the addition of a dedicated material having characteristics described herein or alternatively may be formed from the substrate material of the garment itself. In any event, the regions of extensibility are typically surrounded by the remaining material of which the garment is made, generally a nonextensible material and, thus, the regions of extensibility may be thought of as "islands" of extensible material strategically located throughout the gown.

It should be appreciated that, although the present invention has particular usefulness as a material capable of incorporation into a surgical gown, the invention is not limited in scope to surgical gowns or to the medical industry. The material according to the present invention has wide application and can be used in any instance wherein a user adjustable material is desirable in such garments as protective coveralls, gowns, robes, etc. As such, all such uses and garments are contemplated within the scope of the invention.

The garment, in form according to the invention may be a surgical gown having a conventional body configuration. That is, the garment may have a closed front portion made from a first panel of material and an open back portion defined by back panels that are attached to the first panel of material alongside the seams of the garment. In an alternate embodiment, the garment may have front and back portions formed from a single piece of material. As discussed in greater depth, the style and configuration of the garments of the present invention are not intended to be considered a limiting factor.

In an embodiment of the invention, a protective garment is provided having a garment body. The garment may be, for example, a surgical gown, a protective coverall, etc. Moreover, in one particular embodiment an expandable garment is provided. The expandable garment may have a garment body with two sleeves attached. The garment body and sleeves may be formed of a nonwoven fabric having a first fabric surface and a second fabric surface which is opposite the first fabric surface. A section of the fabric defines at least one region gathered into a plurality of successive pleats. Each pleat is made of an overlap in the fabric such that a portion of the first fabric surface is disposed adjacent to another portion of the first fabric surface. These two adjacent surfaces are affixed to one another. The entire region is selectively extensible by application of a tensile force to the region which causes the two surfaces to at least partially detach thus enabling the pleat to at least partially unfold. In a further embodiment, it may be desirable to place a plurality of such regions upon sections of the garment. Each region may be adapted to be independently lengthened to accommodate different size individuals. For example, the regions may be adapted to affect overall garment length, affect overall sleeve length, and to affect garment width. A secondary panel attached via attachment points to the fabric may also be provided. The secondary panel may be made to straddle a pleat and separate at a predetermined region upon application of a tensile force to the region. This would result in the pleat to at least partially unfold. Such a garment may prove useful as medical apparel, surgical gowns, shirts, and/or coveralls.

In another embodiment, an extensible material for use in a garment is provided. Such a material may be configured as a fabric having a length, a first surface, and an opposing second surface. The fabric may contain at least one pleat transverse to the length. The pleat may be made by overlapping the fabric such that a first portion of the first surface is disposed adjacent to a second portion of the first surface. A secondary panel made of a separable material may be provided. The secondary panel may be made to straddle a pleat in the fabric. The secondary panel may be attached to the fabric by attachment points that are adapted to retain the pleat in a folded state until application of a tensile force directed along the fabric length causes the secondary panel to separate which would enable the pleat to unfold.

The required tensile force may be applied by a wearer pulling on the material. The adhesive may be applied so that application of the tensile force results in an incremental release of the affixed portions or application of the tensile force may result in a smooth release of the affixed portions.

Embodiments of the protective garment according to the invention are described below in greater detail with reference to the appended figures.

DETAILED DESCRIPTION OF THE INVENTION

Figure 1:
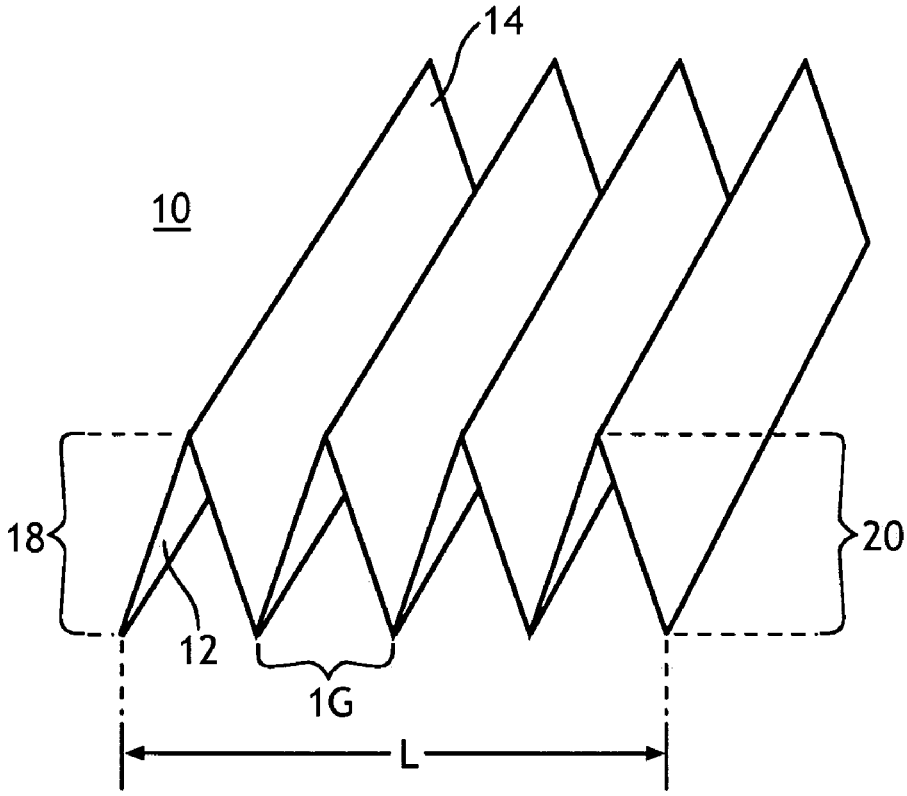
FIG. 1 illustrates one embodiment of an exemplary section of an extensible material according to the present invention.

Reference will now be made in detail to one or more embodiments of the invention, examples of which are graphically illustrated in the drawings. Each example and embodiment are provided by way of explanation of the invention, and not meant as a limitation of the invention. For example, features illustrated or described as part of one embodiment may be utilized with another embodiment to yield still a further embodiment. It is intended that the present invention include these and other modifications and variations.

FIG. 1 illustrates an exemplary section of an extensible material 10 which may prove useful for incorporation into those garments where adjustability of portions of the garment to accommodate different size wearers is found especially desirable. An exemplary material 10 would have an initial length "L", a first surface 12, and a second surface 14 disposed opposite the first surface 12. A pleat 16 or a series of such pleats 16 would be formed into the material 10. These pleats and the manner in which they are employed form the predominant means with which the material is extended. Each pleat 16 is created by folding the material 10 over upon itself so that a portion of one surface lies adjacent to another portion of the same surface. For example, the material 10 in this embodiment is overlapped in a direction that lies perpendicular to the length "L" of the material 10 so that for any one pleat, a first portion 18 of surface 12 is superposed with a second portion 20 of surface 12.

Figure 2:
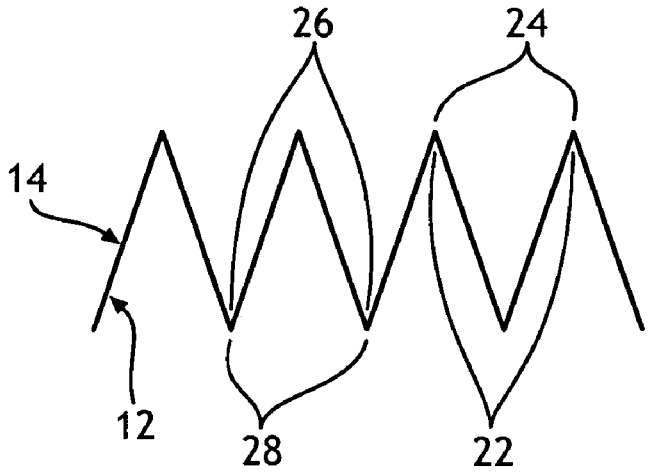
FIG. 2 is an end view of the FIG. 1 embodiment.

Looking now to FIG. 2, a diagram of an exemplary pleat 16, may be seen. In this configuration, each pleat 16 is formed by creasing or folding the material 10 such that a first crease 22 having a first peak 24 is formed. The peak 24 points in a direction away from the plane originally established by the first surface 12 prior to folding the material 10. A second crease 26 is formed in the material 10 a desirable distance from the first crease 22 in a similar manner. This second crease 26 forms a second peak 28, that points in a direction opposite that of the first peak 24, i.e., second peak 28 points in a direction toward the plane originally established by the first surface 12 prior to folding the material 10. As such, the crease 26 may also be considered a reverse fold of the first crease 22. A series of these folds or creases 22 and 26 are alternately repeated in a pattern to form a plurality of pleats 16 until a desirable number of pleats are formed in the material 10. Such an arrangement may take on the appearance of an accordion-like folding pattern where each pleat 16 may be identified as beginning with a crease 26 and ending with the next consecutive crease 26. However, it is only a matter of semantics to identify a pleat in this manner, a pleat may also be considered to begin with a crease 22 and end with the next consecutive crease 22 if desired.

Figure 3:
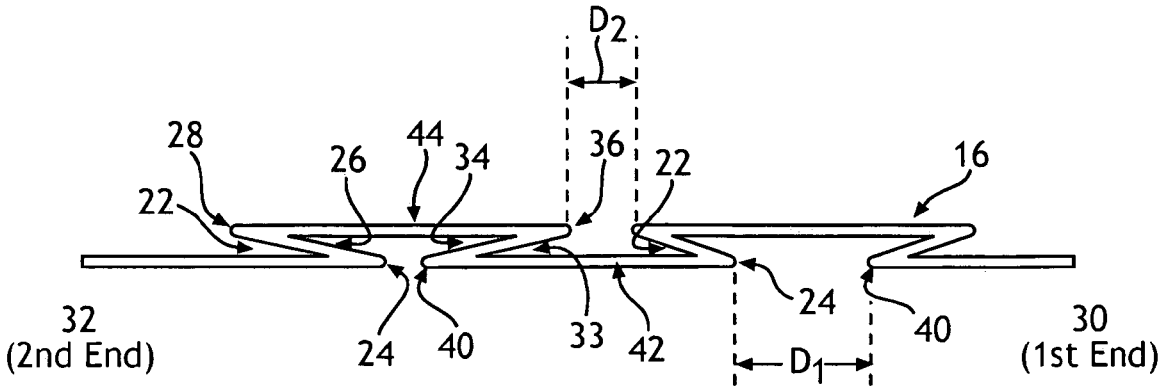
FIGS. 3-6 depict alternative pleat configurations of an extensible material of the present invention.

Turning to FIG. 3, an alternative pleat 16 is depicted. In this embodiment, each pleat 16 is formed by creasing or folding the material 10 so as to create the first crease 22 having the first peak 24. However, in this embodiment the first peak 24 points generally toward a first end 30 of the material 10. The second crease 26 is oppositely folded from the first crease 22 in a manner similar to the FIG. 2 embodiment, however, the second peak 28 points in a direction opposite that of the first peak 24. That is the second peak 28 points toward a second end 32 of the material 10. A third crease 34 is formed in the material 10. The third crease has a third peak 36 that again points toward the first end 30 of the material 10. A fourth crease 38 is also formed in the material 10. The fourth crease 38 has a fourth peak 40 that points toward the second end 32 of the material 10. As depicted, creases 22 and 38 have a section 42 of material 10 disposed therebetween, each section 42 begins and ends with peaks 24 and 40 respectively. Looking to successive sections 42, it can be seen that the peak 24 of the first section 42 is located a distance "D1" from the peak 40 of the next consecutive section 42 of material 10. In a similar fashion, creases 26 and 34 have a section 44 of material 10 disposed therebetween beginning and ending with peaks 28 and 36 respectively. Looking now to successive sections 44, it can also be seen that the peak 28 of one section 44 is located a distance "D2" from the peak 36 of the next consecutive section 44 of material 10. The dimensions D1 and D2 are not critical to the invention. These dimensions may be the same or they may differ with respect to each other. Moreover each D1 dimension may be different from any other D1 dimension and each D2 dimension may be different from any other D2 dimension.

Figure 4:
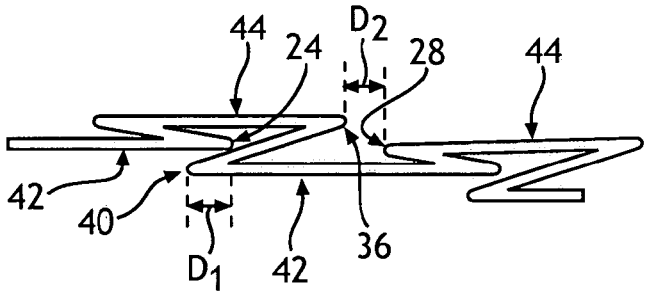

In looking to FIG. 4, it may be seen that D1 as well as D2 may reflect a negative value or physically, an overlap of the material 10. That is, FIG. 4 depicts the dimension D1 as reflecting the amount of overlap between peak 24 of the first section 42 and peak 40 of the next consecutive section 42 of material 10. The dimension D2 in this FIG. continues to be represented as a positive value which corresponds to a separation between peaks 28 and 36 of two consecutive sections 44. However, it should be understood that the dimension D2 may also represent a negative value or overlap. Likewise, the dimension D1 may be a positive value when the dimension D2 is a negative value. As should also be understood any combination of values between the dimensions D1 and D2 are possible. FIG. 4 is provided to depict one exemplary arrangement. Other arrangements are contemplated and one skilled in the art would understand such other arrangements resorting to this description in conjunction with FIGS. 3 and 4.

Figure 5:
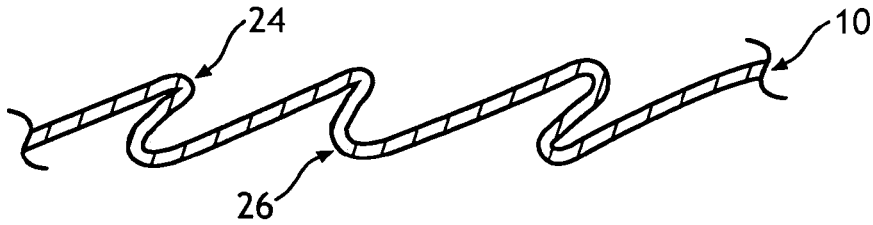
Figure 6:
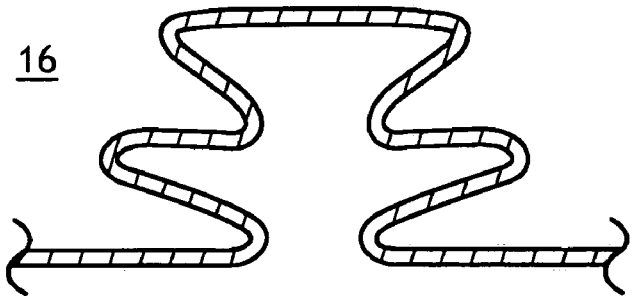

FIG. 5 depicts an alternative configuration similar to the FIG. 2 embodiment. In lieu of the accordion-fold arrangement depicted in FIG. 2 however, FIG. 5 depicts an overlapping of the peaks 24 and 28 similar to that shown in FIG. 4. FIG. 6 depicts still an alternative pleat 16. This pleat 16 is similar to that shown in FIG. 4, however, there is an additional depth made up of additional creases. These are not labeled in the FIG, simply because the FIG. is meant to depict the many configurations of pleat which are available to choose depending upon how complex the manufacturer wishes to make the pleat as well as the length of material the manufacturer wishes to fold into a discrete area. As such, each crease and overlap in the material enables a greater total length of material to be folded into a smaller space. Nonetheless these FIGS. are intended to depict that each pleat 16 no matter its configuration begins with an arbitrarily identified starting crease and terminates at a subsequent crease. The specific crease at which the pleat terminates may be identified by looking to the entire repeat folding pattern in the material. Each repeat folding pattern may be thought of as constituting an individual crease.

Despite the specific form of the pleat 16, each pleat is initially secured so as to prevent its being unfolded without first subjecting it to the application of a predetermined tensile force acting thereon. In one embodiment, best seen in FIG. 7, a secondary panel 50 is disposed adjacent to the material 10. This secondary panel 50 may be a sheet material designed to separate or tear at a predetermined region, such as along a perforation 52 also referred to as a perforated region 52. It should be envisioned that application of a tensile force in the direction of the arrows "$F_T$" or "$F'_T$" will result in the failure of at least one perforated region 52. Likewise, continued application of force will result in the failure of other individual perforated regions 52. As such, in most embodiments the application of force on a material of this nature will result in the intermittent or periodic release of individual perforated regions 52.

Figure 7:
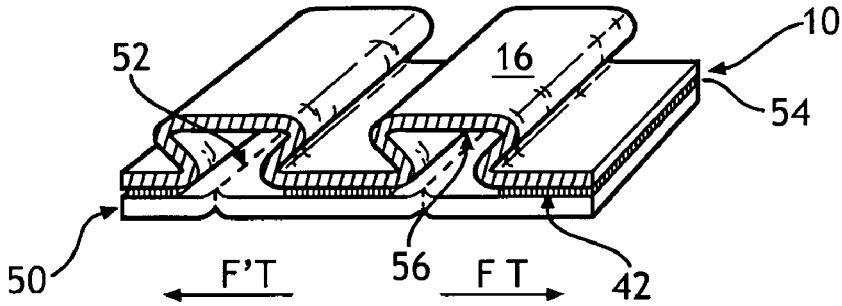
FIGS. 7-9 depict pleat embodiments with the secondary panel affixed thereto.

In some embodiments, the secondary panel 50 is affixed to the material 10 at attachment points 54. These attachment points 54 may be implemented through the use of various means including but not limited to the application of thermal, ultrasonic, chemical, and/or mechanical bonds including adhesives. The attachment points in FIG. 7 depict the panel 50 as being attached to the material 10 along portions of section 42. It should be understood that these attachment points 54 may also be used to affix the panel 50 with sections 44. In some embodiments the inner surfaces of the pleats may be affixed in like manner. These inner surfaces are designated as surface 56 in the FIG.

In other embodiments, the secondary panel itself may be manufactured of a tearable or frangible material designed to fail under application of a low tensile load, such as, for example, about 2500 grams-force or less. Failure may occur in the structure of the panel itself or may simply be failure of the attachment points with respect to the secondary panel. In any event, materials that may be found suitable in the manufacture of the secondary panel include but are not limited to layers of spunbond, meltblown, coform, airlaid, carded and hydroentangled fibers, and pulp fibers, including paper. The layers may or may not be creped. In addition, other types of layers such as films, tissues, and foams may be used in the nonwoven wiper.

Figure 8:
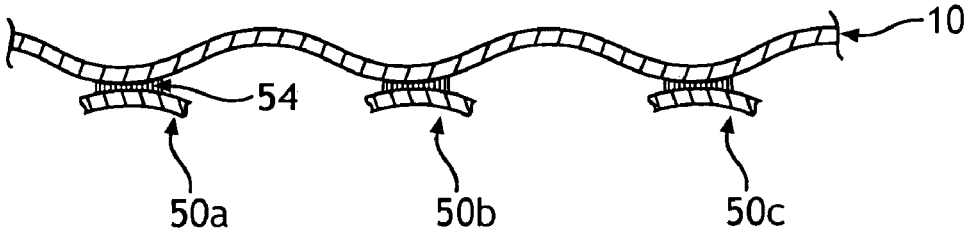

It should be seen that each perforation 52 or other region of weakness is aligned with the pleat 16 in the material 10 in such a manner that tearing of the perforation 52 or of the panel 50 itself will enable the pleat 16 to unfold thereby effectively lengthening the material 10. Consequently, in FIG. 7, the perforation is located at that dimension labeled as D1 in FIG. 3. Looking back to FIG. 7 it may be seen that the material 10 will initially be in the configuration depicted, i.e., the pleat 16 will be in an initial folded orientation within the material. Upon application of the requisite force, the perforation 52 will fail thereby separating the panel 50 into disparate panel sections 50*a*, 50*b*, and 50*c* as depicted on FIG. 8. The actual number of panel portions will be dependent upon the number of perforations 52 or portions contained within the panel 50 that are caused to separate.

Figure 9:
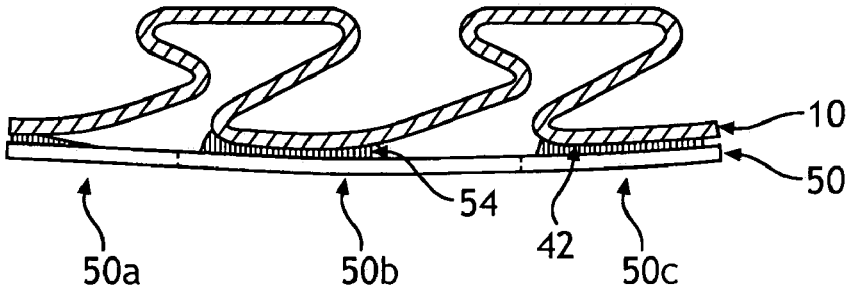

Turning to FIG. 9, the pleat of FIG. 4 is depicted. In this configuration, the perforation 52 may not lie coincident with the D1 dimension described above. However, as may be seen, the secondary panel 50 may in fact be attached via points of attachment 54 that place the perforation 52 for example at section 42. It should be understood that application of an appropriate force on this embodiment will also result in separation of the panel 50 into multiple panel sections 50*a*, 50*b*, and 50*c*. Therefore, it should be evident that the specific embodiment of the pleat is not critical, an important aspect of the present invention is simply that the secondary panel 50 retain the pleat in a folded condition until such time that a force is applied to the panel 50 resulting in a separation of the panel 50 into multiple panel subsections 50*a*, 50*b*, and 50*c*.

Figure 10:
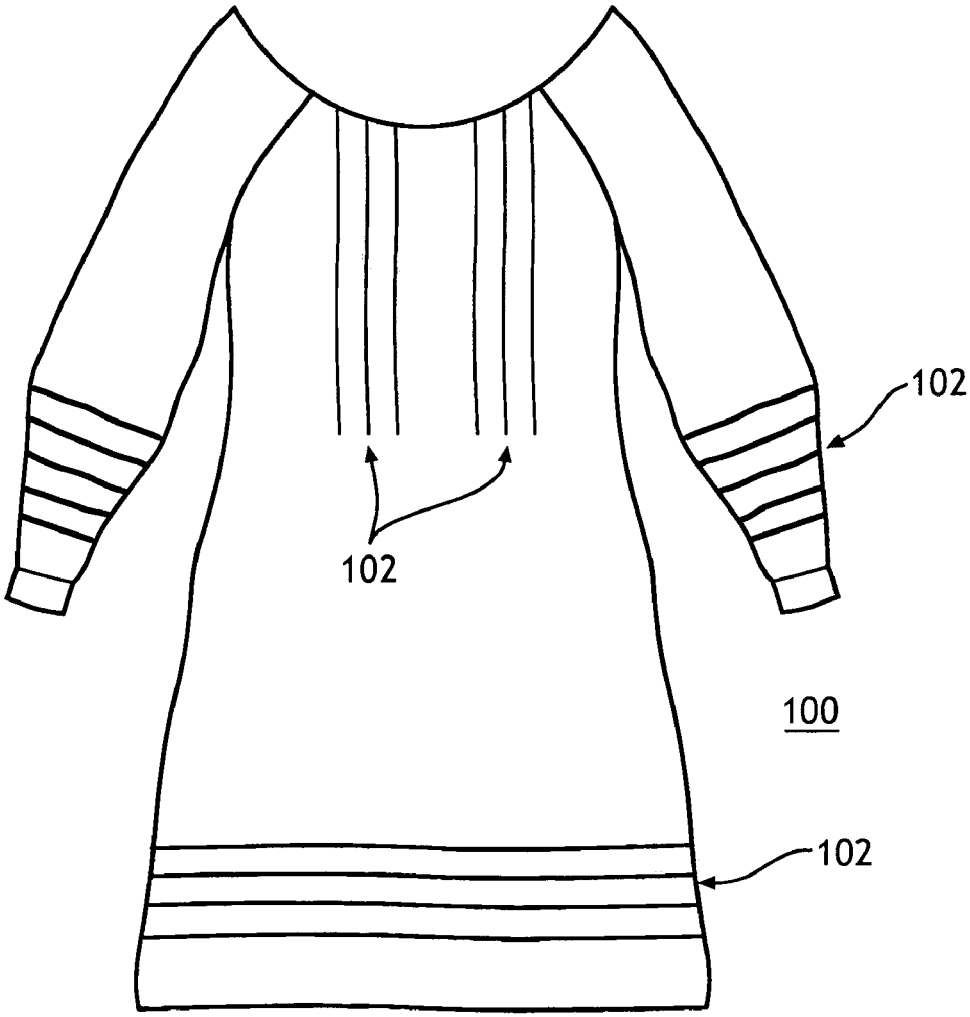
FIG. 10 depicts a surgical gown incorporating the material of the present invention.

The present invention thus far has described a material 10 that may be found useful in making a unique configuration of protective garments, particularly surgical gowns 100 such as shown in FIG. 10, wherein regions 102 of the extensible material 10 are selectively provided in the garment so as to enable adjustability to accommodate various size wearers. These areas or regions 102 may be incorporated into the garment by the addition of a dedicated material having characteristics described above, or alternatively the regions 102 may be formed from the substrate material comprising the gown itself by incorporation of the appropriate folds thereby creating the creases. The secondary panel may be on the interior or exterior surface of the gown. However, if the garment were to serve as a surgical gown, it may be prudent to place the panel be internal to gown so as to minimize potential contamination of a surgical site from stray fibers or debris that may inadvertently be shed due to the separation of the secondary panel 50. As such, the secondary panel is not depicted in FIG. 10.

Nonetheless, these regions 102 of extensibility are typically surrounded by the remaining material from which the garment is made. This material may be a nonextensible material such as a nonwoven substrate. In this case, the regions 102 of extensibility may be thought of as "islands" of extensible material strategically located in an otherwise nonextensible material comprising the gown 100.

It should, however, be appreciated that any garment made in accordance with this invention, including the surgical gown 100 depicted, is not limited to any particular type of materials. Conventional materials for forming gowns are well known to those skilled in the art, and any such material may be used for a gown in accordance with the present invention. As such, the gown 100 may be made from a multitude of materials, including nonwoven materials suitable for disposable use. A material particularly well suited for use with the present invention is a three-layer nonwoven polypropylene material known as SMS. "SMS" is an acronym for Spunbond, Meltblown, Spunbond, the process by which the three layers are constructed and then laminated together. See for example U.S. Pat. No. 4,041,203 to Brock et al. One particular advantage is that the SMS material exhibits enhanced fluid barrier characteristics, making it desirable for use in a surgical setting. It should be noted, however, that other nonwovens as well as other materials including wovens, knits, films, foam/film laminates, and combinations thereof may be used in the construction of the present invention. Likewise, there are a number of elastomeric extensible materials used in the art that may serve adequately and would enhance the function of the extensible regions 102 used in the present invention. As such, it should be appreciated that the type of fabric or material used for the gown 100 is not a limiting factor of the invention.

Additionally, it should be appreciated that, although the present invention has particular usefulness as a material capable of incorporation into a surgical gown, the invention is not limited in scope to surgical gowns or to the medical industry. The material according to the present invention has wide application and can be used in any instance where a user adjustable material is desirable in such garments as protective coveralls, gowns, robes, etc. Consequently, all such uses and garments are contemplated within the scope of the invention. The value of the material may be easily understood by drawing a comparison to the present state of the art with respect to the solution presented herein. Presently a wearer of a disposable garment is provided with a single predetermined size. Custom fitting of such garments is inherently impractical, therefore portions of the garment are often left long or loose to accommodate a larger percentage of wearer body shapes and sizes. Incorporation of the material described herein in certain areas, for example, in the garment arm sleeves, the garment leggings, at the chest and torso region, as well as those regions directed to total garment length provides a wearer with adjustability. The garment would initially appear to be foreshortened, however, by pulling or tugging on the garment at the appropriate region, i.e., providing the necessary tensile force, that region of material is extended by the partial or full unfolding of pleats contained in the region. This results in a lengthening of the garment at the specific region needed for proper fit for the wearer.

It should be appreciated by those skilled in the art that various modifications and variations can be made to the embodiments of the present invention described and illustrated herein without departing from the scope and spirit of the invention. The invention includes such modifications and variations coming within the meaning and range of equivalency of the appended claims.

The invention claimed is:

1. An expandable garment comprising:

a garment body having two sleeves attached thereto, the garment body and sleeves formed of a nonwoven fabric having a first fabric surface and a second fabric surface opposite the first fabric surface, a section of the fabric defining at least one region gathered into a plurality of successive pleats, each pleat comprising an overlap in the fabric such that a portion of the first fabric surface is disposed adjacent to another portion of the first fabric surface, a secondary panel attached via attachment points to the fabric, the secondary panel straddling a pleat and adapted to separate at a predetermined region upon application of a tensile force to the region causing the pleat to at least partially unfold, wherein the secondary panel is perforated and separation of the secondary panel occurs at the perforation.

2. The garment of claim 1 comprising a plurality of regions disposed upon sections of the garment, each region adapted to be independently lengthened to accommodate different size individuals.

3. The garment of claim 1 wherein the region is adapted to affect overall garment length.

4. The garment of claim 1 wherein the region is adapted to affect overall sleeve length.

5. The garment of claim 1 wherein the region is adapted to affect overall sleeve width.

6. The garment of claim 1 wherein the region is adapted to affect garment width.

7. The garment of claim 1 wherein the garment is selected from a group consisting of medical apparel, surgical gowns, shirts, and coveralls.

* * * * *